United States Patent [19]

Kizior

[11] 4,383,914

[45] May 17, 1983

[54] DILUTION CENTRIFUGING OF BITUMEN FROTH FROM THE HOT WATER PROCESS FOR TAR SAND

[75] Inventor: Thaddeus E. Kizior, Edmonton, Canada

[73] Assignees: Petro-Canada Exploration Inc.; Her Majesty the Queen in right of the Province of Alberta; Ontario Energy Corp.; Imperial Oil Ltd.; Canada-Cities Service, Ltd.; Gulf Oil Canada Ltd., all of Canada

[21] Appl. No.: 264,328

[22] Filed: May 18, 1981

Related U.S. Application Data

[63] Continuation of Ser. No. 70,588, Aug. 29, 1979, abandoned, which is a continuation-in-part of Ser. No. 849,589, Nov. 8, 1977, abandoned, which is a continuation-in-part of Ser. No. 746,667, Dec. 2, 1976, abandoned.

[30] Foreign Application Priority Data

Dec. 10, 1975 [CA] Canada ..... 241479

[51] Int. Cl.[3] ..... C10G 1/00

[52] U.S. Cl. ..... 208/177; 208/11 LE; 210/703; 210/781

[58] Field of Search ..... 210/781, 782, 783, 799, 210/776, 258, 416.1, 416.5, 702–708; 208/11 LE, 177

[56] References Cited

U.S. PATENT DOCUMENTS 3,808,120 7/1974 Smith ..... 208/11 LE
3,828,929 8/1974 Hickey ..... 210/781

FOREIGN PATENT DOCUMENTS 918091 1/1973 Canada ..... 208/11 LE

OTHER PUBLICATIONS

Perry's Chemical Engineering Handbook, Perry, Fourth Edition, McGraw-Hill Book Co., 1969, 6-5--6-8.

*Primary Examiner*—Ernest G. Therkorn
*Attorney, Agent, or Firm*—Millen & White

[57] ABSTRACT

In the known operation wherein naphtha-diluted bitumen froth is pumped from a scroll-type centrifugal separator to a disc-type centrifugal separator, an improved pumping system is provided. The system comprises at least two centrifugal pumps in series, each operating preferably at an impellor tip speed less than 4000 feet/minute. The invention is based on the discovery that dilution with naphtha greatly increases the emulsification tendency of the froth components; therefore it is necessary to reduce shearing of this stream to keep the solids and water content of the disc product within a desirable limit. This is achieved by using staged pumping and operating the pumps at a relatively low tip speed.

1 Claim, 3 Drawing Figures

DILUTION CENTRIFUGING OF BITUMEN FROTH FROM THE HOT WATER PROCESS FOR TAR SAND

This is a continuation of application Ser. No. 070,588, filed Aug. 29, 1979, which is a continuation-in-part of Ser. No. 849,589, filed Nov. 8, 1977, and which is a continuation-in-part of Ser. No. 746,667, filed Dec. 2, 1976, all now abandoned.

BACKGROUND OF THE INVENTION

This invention relates to a method for treating bitumen froth produced from tar sand by a hot water extraction process plant. More particularly, it relates to a system for pumping froth, diluted with light hydrocarbon, from a scroll-type centrifugal separator to a disc-type centrifugal separator within the two-stage centrifuge circuit that is conventionally used to recover the bitumen from the froth.

One of the world's largest reservoirs of hydrocarbons is the Athabasca tar sand deposit in Northern Alberta. The oil or bitumen from this deposit is presently being extracted using the known hot water process.

In general terms, this process involves mixing tar sand with water and steam in a rotating tumbler to initially separate the bitumen from the water and solids of the tar sand and to produce a slurry. The slurry is diluted with additional water as it leaves the tumbler and is introduced into a cylindrical primary settler vessel having a conical bottom. The largest part of the coarse sand particles settles out in the vessel and is removed as an underflow and discarded. Most of the bitumen and minor amounts of solids and water form a froth on the surface of the vessel contents. This froth overflows the vessel wall and is received in a launder extending around its rim. It is referred to as primary froth. A middlings stream, comprising water, fine solids (−325 mesh), and a minor amount of buoyant and non-buoyant bitumen, is withdrawn from the mid-section of the vessel and is pumped to a sub-aeration flotation cell. Here the middlings are agitated and aerated to an extent greater than that within the primary vessel. The middlings bitumen and some water and solids become attached to the air bubbles and rise through the cell contents to form a froth. This froth, referred to as secondary froth, is recovered in a launder and may then preferably be settled to reduce its water and solids content. The primary froth and settled secondary froth are combined and preferably deaerated and heated with steam in a column. Typically the deaerated froth comprises 62% bitumen, 29% water and 9% solids. The temperature of the froth after deaeration is typically 185° F.

Following deaeration, the froth is pumped through a feed conduit to a two-stage dilution centrifuging circuit. In the first step of this circuit, a hydrocarbon diluent is injected into the feed conduit to mix with the froth. The diluent, usually naphtha, is added to reduce the viscosity and specific gravity of the froth bitumen phase and render it amenable to centrifugal separation. The diluted froth is then treated in one of a battery of scroll separators. This separator battery removes most of the coarse particles from the froth being treated. The scroll product is then pumped through one of a battery of disc separators to remove the remaining fine solids and water and produce a relatively clean, diluted bitumen stream.

It is known that emulsification of the bitumen, solids and water takes place as the froth moves through the process. This emulsification affects the quality of the bitumen product obtained from the disc separators. That is, the water and solids content of the disc product increases due to upstream emulsification.

In order to obtain a disc product which is acceptable for utilization in downstream bitumen upgrading units, it is conventional to add a chemical demulsifier to the feed stream just before it enters the disc separator. When one considers the size and throughput of a commercial hot water extraction plant, it will be appreciated that the cost for such demulsifier addition is substantial.

In accordance with this invention, it has been discovered that the problematic emulsification of the froth components occurs after the hydrocarbon diluent has been added. More particularly, as a result of work carried out in a test circuit, it has been found that if the deaerated froth is rigorously agitated in a mixing tank prior to the addition of naphtha, and if a low shear progressive cavity pump is used to transfer the product from the scroll separator to the disc separator, then the water and solids content in the disc separator product is relatively low, i.e. in the order of 5% of volume or less. However, when a commercial-type high shear centrifugal pump is substituted for the progressive cavity pump in this circuit, the water and solids content of the disc separator product increases substantially and is higher than the 5–7% content deemed to be necessary for the downstream refinery-type upgrading units.

SUMMARY OF THE INVENTION

Having discovered that emulsification only becomes a serious problem after the hydrocarbon diluent has been added to the froth, and that a centrifugal pump run at high tip speed is the main component acting to emulsify the diluted bitumen stream, we have determined that low shear pumping can successfully be used between the first and second stages of centrifugal separation to reduce emulsification to an acceptable level.

Three requirements are to be met:

(1) that the pumping means be simple due to the abrasive and uncongenial nature of the material being pumped;

(2) that sufficient energy be imparted to the stream to both raise the head pressure for adequate transfer of the stream, and to generate adequate volumetric flow; and (3) that the energy be imparted in such a manner that the emulsification problem, to which the streams are prone, is advantageously reduced.

Emulsification is encouraged by centrifugal pumps of high tip speed. But if a single pump is used, a high tip speed is necessary to generate adequate head pressure and volumetric flow. The problem cannot be avoided by using a large slow-acting pump since a minimal tip speed is required, and this tip speed is always above the speed where emulsification becomes undersirably high. On the other hand centrifugal pumps are simple and well established for the present purposes. To gain the advantages of using the simple centrifugal pumps but to avoid the emulsification problem, two or more centrifugal pumps in series are used, each operating at less than its design speed. Energy imparted is additive but high tip speeds are avoided.

Broadly stated, the invention is an improvement in the known dilution centrifuging process, wherein deaerated bitumen froth, comprising bitumen, water and coarse and fine solids, is diluted with hydrocarbon, and is treated in a scroll-type centrifugal separator to remove coarse solids, is pumped by centrifugal pump means to a disc-type centrifugal separator and is treated in the latter separator to separate the diluted bitumen from the water and fine solids. The improvement comprises normally pumping the bitumen-rich product stream obtained from the scroll separator to the disc separator using two or more centrifugal pumps in series, each pump being operated at less than 4,000 feet per minute impellor tip speed.

DESCRIPTION OF THE PREFERRED EMBODIMENT

Figure 1:
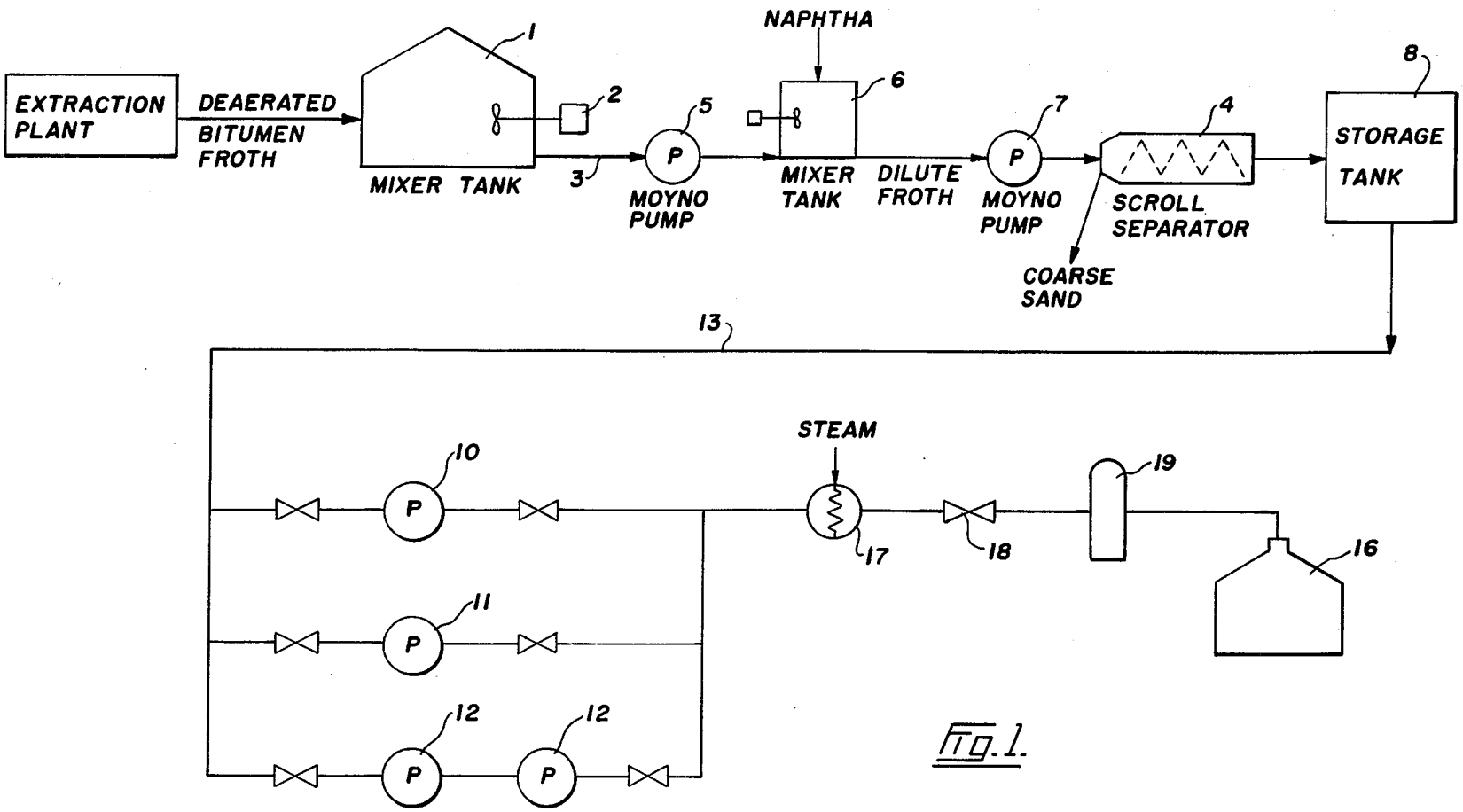
FIG. 1 is a schematic showing a test circuit wherein deaerated froth is mixed, diluted with naphtha, treated in a scroll separator and then treated in a disc separator to produce clean bitumen—it is to be noted that the scroll separator product can be pumped by either a progressive cavity pump, centrifugal pump or staged centrifugal pumps in series through a pressure let-down valve to the disc separator.

Making reference to FIG. 1, the test circuit used to develop this invention involved introducing deaerated froth, from a hot water bitumen extraction plant, into a mixer tank 1. Here the froth was retained for a period of time and agitated with mixers 2. The mixed froth was then pumped through a conduit 3 to a scroll separator 4 by a progressive cavity pump 5. Naphtha was introduced into the conduit 3 at a tank 6 between the pump 5 and scroll separator 4. The rate of naphtha addition was selected to dilute the froth to a level at which it was amenable to centrifugal separation. On passing the diluted froth through the scroll separator 4, the bulk of the coarse sand particles was removed and discarded as a tailings stream 7 while the diluted bitumen product stream 8 was collected in a tank 9. From this tank, the diluted bitumen product was pumped by either a progressive cavity pump 10, a centrifugal pump 11, or staged centrifugal pumps 12 through a conduit 13, boot valve 14 and filter 15 into a disc separator 16. On passing the diluted bitumen product through the disc separator 16, the water and solids were largely separated and discarded as a tailings stream while diluted bitumen was recovered.

It was a requirement, arising from the commercial design of a dilution centrifuging circuit that was used in the tests, that the pump means used to feed the diluted bitumen stream to the disc separator had to develop a discharge pressure of approximately 40 psig. It was found that when this operating condition was observed, the solids plus water content of the diluted bitumen product of the disc separator was acceptably low (i.e. about 5% or less) when the progressive cavity pump 10 was used; however when the centrifugal pump 11 was used and run at its design capacity, the diluted bitumen product of the disc separator contained an unacceptably high solids plus water content (i.e. about 9% or greater). From this it was concluded:

(a) that the naphtha-free bitumen froth could be subjected to high shear in the mixer tank 1 without that degree of emulsification taking place which would result in a diluted bitumen product of the disc separator having an unacceptably high solids plus water content; and (b) that subjecting the diluted bitumen product of the scroll separator to high shear with the centrifugal pump 11 caused problematic emulsification to occur, with the result that the solids plus water content of the diluted bitumen product of the disc separator was unacceptably high.

It was hypothesized that, if the flowrate to the disc separator is kept constant, the amount of energy imparted to the diluted bitumen stream is directly proportional to the discharge pressure of the pumping unit while the rate at which this energy is imparted is directly proportional to the shear rate, or alternatively, to the impellor tip speed. Therefore, staged pumping using two centrifugal pumps 12, 12 in series was tried.

The invention is exemplified by the following examples:

EXAMPLE 1

Table I presents grouped and averaged data of centrifugal pump tests. Although many experiments were conducted, the data contained a large amount of scatter, probably due to the significant changes in the froth character which was encountered during the experiments. To average out the scatter, the data for each of the one and two-stage pump tests was divided into three groups and averaged within each group. The average feedrate to the DeLaval* disc separator was approximately the same for all of the tabulated tests, and the capacitance tank pressure was maintained at 10 psig throughout.

* trade mark

TABLE I

| No. of Stages | Tip Speed (fpm) | Pump Discharge Press (psig) | Vol. % Water & Solids in Product |
|---|---|---|---|
| 1 | 2460 | 12 | 8.3 |
| 1 | 3810 | 28 | 8.4 |
| 1 | 5010 | 49 | 12.4 |
| 2 | 2640 | 27 | 8.9 |
| 2 | 3560 | 50 | 8.6 |
| 2 | 4470 | 78 | 14.7 |

Figure 2:
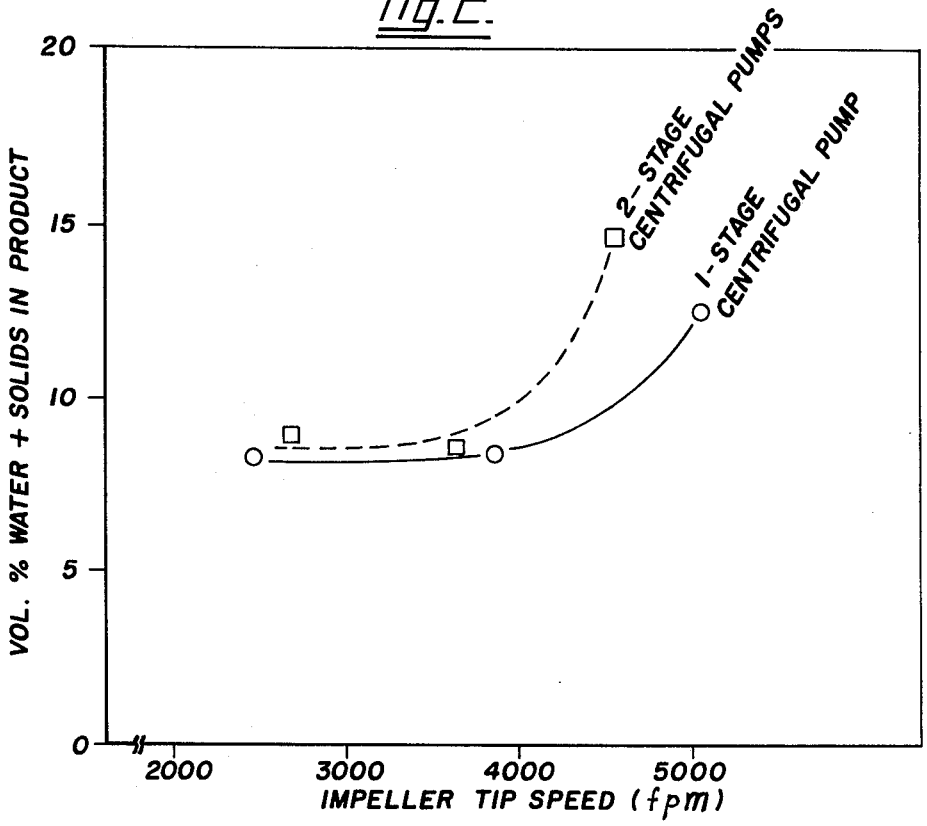
FIG. 2 is a plot showing the contamination of the diluted bitumen product of the disc separator as a function of the impellor tip speed for both one and two-stage centrifugal pumps.
Figure 3:
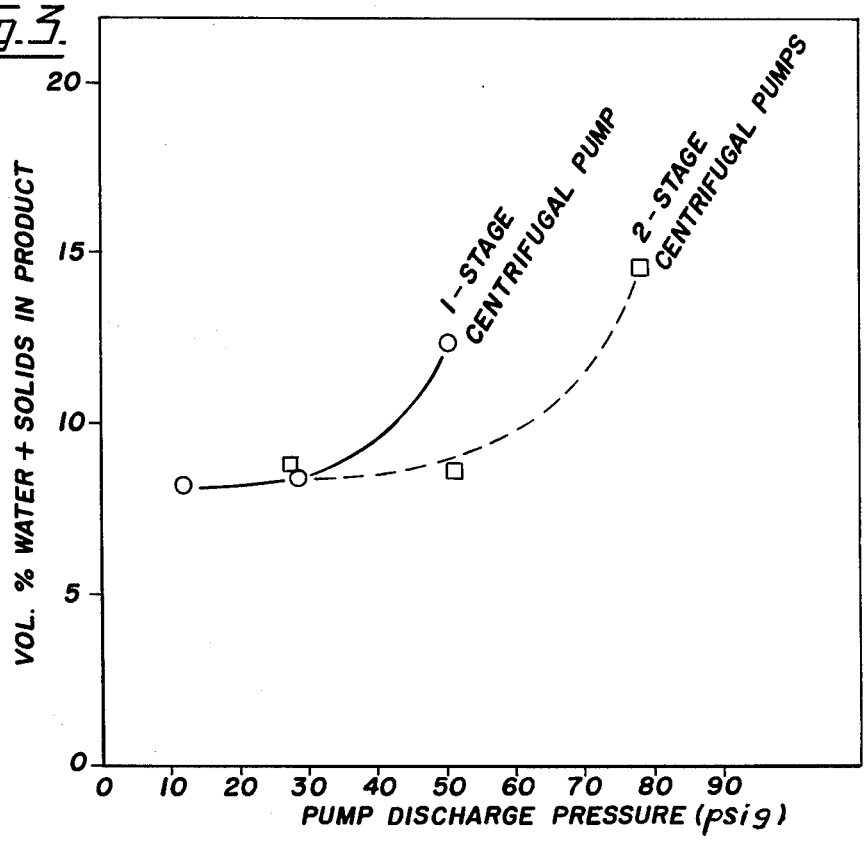
FIG. 3 is a plot showing the contamination of the pump discharge pressure for both one and two-stage centrifugal pumps.

The above averaged data is graphically shown in FIGS. 2 and 3.

As the degree of emulsification of the diluted bitumen stream increases the separation of the bitumen from the water and solids is poorer. Therefore, FIG. 2 can be viewed as a plot of the degree of emulsification as a function of the rate of imparting energy to the diluted bitumen stream. Data for both the one and two-stage pumps show that the degree of emulsification, or the volume percentage of water and solids in the diluted bitumen product of the disc separator, is worse at impellor tip speeds of 4000–5000 fpm than at tip speeds of 2500–3500 fpm. FIG. 2 also shows that the two-stage pump causes a higher degree of emulsification than a one-stage pump at tip speeds in the range of 4000–5000 fpm. However, for a given impellor tip speed, the amount of energy imparted by the two-stage pump is twice the amount imparted by the one-stage pump.

FIG. 3 is a plot of the volume percentage of water and solids in the diluted bitumen product of the disc separator as a function of the pump discharge pressure for both the one and two-stage pumping systems. As stated earlier, the pump discharge pressure is a measure of the amount of energy imparted to the diluted bitumen stream by the pump. At a fixed discharge pressure, for example 50 psig, the amount of energy absorbed by the diluted bitumen stream from the one pump system is exactly the same as from the two pump system. However, the one pump system would have to run at a higher impellor tip speed than the two pump system in order to supply the same amount of energy. FIG. 3 shows that for a required pump discharge pressure of 50 psig; the one pump system with a relatively high tip speed has increased the degree of emulsification while the two pump system with a relatively low tip speed has not.

By keeping the impellor tip speed of two centrifugal pumps in series low, a pump system discharge pressure of 40 psig could be obtained in conjunction with a satisfactory solids plus water content in the diluted bitumen product of the disc separator. It now appears that the use of demulsifiers in the process may be dispensed with.

In summary, it is proposed to use multiple pumps operated at a low impellor tip speed to introduce the energy into the diluted bitumen stream needed to feed the stream to the second stage separators at the required feed pressure.

EXAMPLE 2

Deaerated bitumen froth, comprising 62% bitumen, 29% water and 9% solids and having a temperature of 190° F., was supplied at a rate of 9 IGPM to an 8 foot diameter by 15 foot long mixer tank 1. The froth was stirred in the tank 1 for a period of 11 hours by Prochem* 22 inch diameter mixers operating at 420 rpm. Froth was withdrawn from the tank 1 by a 1 L10 Moyno* progressive cavity pump 5 at a rate of 14.7 IGPM and pumped with a discharge pressure of 6 psig through a conduit 3 to a mixer tank 6. 5.3 IGPM of naphtha, preheated to 120° F., were injected into the mixer tank 6 to mix with and dilute the bitumen. A 3L6 Moyno* pump 7 was used to pump the diluted froth mixture from the mixer tank 6 to the scroll separator 4. The delivery pressure at the separator 4 was 2 psig. The scroll separator, a 12 inch×30 inch Bird* unit, processed the 170° F. stream of dilute deaerated froth at 1150 rpm and produced a bitumen-rich product comprising 72% hydrocarbon, 4% fine solids and 24% water. This product was received and stored in a tank 8. Feed stock was withdrawn from the tank 8 and fed to disc separator 16 by either: (a) a Moyno* 2L6 progressive cavity pump 10; (b) a Crane Deming* 1½ inch×1 inch centrifugal pump 11; or (c) a pair of Crane Deming* 1½ inch×1 inch and A.C.* 1½ inch×1 inch centrifugal pumps 12 in series.

*trade mark

More particularly, froth was withdrawn from the tank 8 and pumped through a conduit 13, Brown* fin-tube heater 17, Fisher* 1 inch boot valve 18, and basket strainer filter 19 into a DeLaval* SX 204T disc separator 16. Results of the comparative runs through the three pump systems are given in Table II.

* trade mark

TABLE II

| Pump | Feedrate (IGPM) | Pump discharge pressure (psig) | % $H_2O$ ÷ solids in product |
|---|---|---|---|
| Progressive Cavity | 5.6 | 40 | 3.4 |
| Single Centrifugal | 5.6 | 41 | 8.9 |
| Two Centrifugal in series | 5.6 | 39 | 6.1 |

In a commercial plant, a stock-type centrifugal pump has been used, such as is commonly employed for pumping paper pulp, i.e. a largely aqueous stream with suspended solids. These pumps are commonly designed with impeller tip speeds ranging between about 6300 and 8000 fpm. Three of these stock pumps, having a rated design tip speed of 6380 fpm, were installed in series for each train of the tar sands processing plant. Each pump was operated below the critical emulsification tip speed of about 4000 fpm and preferably below 3700 fpm. The use of three pumps, rather than two, allowed for operational flexibility. Those who operate tar sands plants are well aware that the feed, bitumen quality, and diluent/bitumen ratio, as well as other properties, alter, and such alteration affects the extent to which diluted froth is prone to emulsification. For an easily emulsified stream, all three pumps are brought into use at low speed, whereas for more stable material two are normally used.

The embodiments of the invention in which an exclusive property or privilege is claimed are defined as follows:

1. In a dilution centrifuging process wherein deaerated bitumen froth, comprising bitumen, water and coarse and fine solids, is diluted with hydrocarbon, and is treated in a scroll-type centrifugal separator to remove coarse solids, is pumped by centrifugal pump means to a disc-type centrifugal separator and is treated in the latter separator to separate the diluted bitumen from the water and fine solids, the improvement which comprises:

normally pumping the bitumen-rich product stream obtained from the scroll separator to the disc separator using two or more centrifugal pumps in series, each pump being operated at less than 4000 feet per minute impellor tip speed and at less than its rated design tip speed.

* * * * *